US010215476B2

(12) United States Patent
Bajak et al.

(10) Patent No.: US 10,215,476 B2
(45) Date of Patent: Feb. 26, 2019

(54) REFRIGERATION DEVICE WITH REINFORCED HOUSING

(71) Applicant: BSH HAUSGERAETE GMBH, Munich (DE)

(72) Inventors: Roberto Bajak, Giengen (DE); Xiangfan Guo, Nanjing (CN); Wuba Lei, Anhui (CN); Rainer Spaag, Ellwangen-Roehlingen (DE); Jinghui Chen, Nanjing (CN); Yueqiang Lu, Nanjing (CN)

(73) Assignee: BSH Hausgeraete GmbH, Munich (DE)

( * ) Notice: Subject to any disclaimer, the term of this patent is extended or adjusted under 35 U.S.C. 154(b) by 0 days.

(21) Appl. No.: 15/696,731

(22) Filed: Sep. 6, 2017

(65) Prior Publication Data

US 2018/0073798 A1 Mar. 15, 2018

(30) Foreign Application Priority Data

Sep. 14, 2016 (CN) ..... 2016 1 0825767

(51) Int. Cl.

| | |
|---|---|
| ***F25D 23/00*** | (2006.01) |
| ***F25D 23/06*** | (2006.01) |
| *F25D 23/10* | (2006.01) |
| *F25D 25/02* | (2006.01) |

(52) U.S. Cl.

CPC ..... *F25D 23/067* (2013.01); *F25D 23/064* (2013.01); *F25D 23/066* (2013.01); *F25D 23/10* (2013.01); *F25D 25/02* (2013.01)

(58) Field of Classification Search

CPC .... F25D 23/067; F25D 23/064; F25D 23/066; F25D 23/10; F25D 25/02

USPC ..... 312/401, 406, 406.2, 409, 116

See application file for complete search history.

(56) References Cited

U.S. PATENT DOCUMENTS

| | | | | |
|---|---|---|---|---|
| 2,727,361 A * | 12/1955 | Morton | F25D 11/025 62/175 |
| 3,588,214 A * | 6/1971 | Stimamiglio | F25D 23/064 312/406 |
| 4,134,627 A * | 1/1979 | Kuskowski | F25D 23/085 312/236 |
| 4,903,858 A * | 2/1990 | Clark | F25D 23/064 220/592.02 |

(Continued)

FOREIGN PATENT DOCUMENTS

| | | |
|---|---|---|
| DE | 1451117 A1 | 5/1969 |
| DE | 102005057136 A1 | 6/2007 |
| FR | 2028826 A1 | 10/1970 |

*Primary Examiner* — Janet M Wilkens

(74) *Attorney, Agent, or Firm* — Laurence A. Greenberg; Werner H. Stemer; Ralph E. Locher

(57) ABSTRACT

A refrigeration device has a housing with an inner liner, a lower housing plate, and a beam connecting the inner liner and the lower housing plate. A reinforcing member is fixed on the beam for enhancing a strength of a bottom wall. A cavity is formed between the reinforcing member and a front wall. Thermal insulation material formed by foaming is disposed inside and outside the cavity. The reinforcing member and the front wall of the beam enclose the cavity, so that the thermal insulation material enables the beam and the reinforcing member to form a whole for bearing a force. The assembly is thus improved for preventing deformation of the bottom wall due to impact.

20 Claims, 4 Drawing Sheets

(56) References Cited

U.S. PATENT DOCUMENTS

| | | | | | |
|---|---|---|---|---|---|
| 5,512,345 | A * | 4/1996 | Tsutsumi | F25D 23/063 | 220/592.27 |
| 5,584,551 | A * | 12/1996 | Jenkins | F25D 23/064 | 312/21 |
| 5,720,536 | A * | 2/1998 | Jenkins | F25D 23/085 | 312/401 |
| 6,036,292 | A * | 3/2000 | Mandel | A47B 95/002 | 312/236 |
| 6,773,082 | B2 * | 8/2004 | Lee | F25D 23/063 | 312/401 |
| 8,083,306 | B2 | 12/2011 | Görz et al. | | |
| 2003/0080662 | A1 | 5/2003 | Taylor et al. | | |
| 2012/0297813 | A1 * | 11/2012 | Hanley | F25D 23/064 | 62/331 |
| 2015/0192355 | A1 * | 7/2015 | Joo | F25D 29/005 | 312/401 |

* cited by examiner

REFRIGERATION DEVICE WITH REINFORCED HOUSING

CROSS-REFERENCE TO RELATED APPLICATION

This application claims the benefit, under 35 U.S.C. § 119, of Chinese patent application CN 201610825767.7, filed Sep. 14, 2016; the prior application is herewith incorporated by reference in its entirety.

BACKGROUND OF THE INVENTION

Field of the Invention

The present invention relates to the field of refrigeration technologies, and in particular, to refrigeration devices.

A beam as a connector is widely used in refrigeration device. For example, the beam can connect inner liners of two adjacent upper and lower or left and right storage chambers. For another example, the beam can also connect an inner liner of a lower storage chamber and a lower housing plate. It has been found that, during transportation, a horizontal portion of a beam that connects an inner liner of a lower storage chamber and a lower housing plate is often deformed due to impact and bumping and other reasons because of the location at the bottom of the refrigeration device and has lower strength. The foregoing problem is more evident especially when the refrigeration device is wider.

BRIEF SUMMARY OF THE INVENTION

It is accordingly an object of the invention to provide a refrigeration device which overcomes the above-mentioned and other disadvantages of the heretofore-known devices and methods of this general type and which is not prone to deformation during transportation.

With the foregoing and other objects in view there is provided, in accordance with the invention, a refrigeration device, comprising:

a housing having an inner liner and a lower housing plate, a beam with a bottom wall connected to the lower housing plate and a front wall connected to the inner liner;

a thermal insulation material formed by foaming between the lower housing plate and the inner liner; and a reinforcing member affixed on the beam for enhancing a strength of the bottom wall, the reinforcing member being disposed between the bottom wall and the inner liner; and the reinforcing member and the front wall being disposed to form a cavity therebetween, and having the thermal insulation material filled in the cavity between the reinforcing member and the front wall.

In other words, the objects of the invention are achieved by a refrigeration device that includes a housing in the form of a cabinet with an inner liner, a lower housing plate, a beam that has a bottom wall and a front wall, and a thermal insulation material located between the lower housing plate and the inner liner and formed by foaming; the bottom wall of the beam is connected to the lower housing plate, and the front wall is connected to the inner liner; and a reinforcing member fixed on the beam for enhancing strength of the bottom wall, where the reinforcing member is located between the bottom wall and the inner liner, where a cavity is formed between the reinforcing member and the front wall, and the thermal insulation material is filled in the cavity.

As the reinforcing member and the front wall of the beam enclose a cavity, the thermal insulation material enables the beam and the reinforcing member to form a whole for bearing a force, and the reinforcing member shares a part of an impact force of collision on the bottom wall of the beam, which is therefore conducive to preventing deformation of the bottom wall of the beam.

Optionally, the reinforcing member includes an upper plate portion and a lower plate portion that are opposite to each other; the cavity is located between the upper plate portion and the lower plate portion, and the lower plate portion adheres to the bottom wall. The lower plate portion of the reinforcing member horizontally adheres to an upper surface of the bottom wall of the beam. On one hand, deformation of the bottom wall of the beam can be resisted by selecting a lower plate portion with strong rigidity, and on the other hand, the deformation of the bottom wall of the beam can be directly transferred to the lower plate portion.

Optionally, the reinforcing member includes a connection plate connected to an end of the upper plate portion and an end of the lower plate portion, where the connection plate is provided with a through hole for a foaming liquid in the foaming process to pass through. In the foaming process, the foaming liquid may a) enter the cavity between the two plate portions through a gap between two ends of the upper plate portion and the connection plate, or may also b) enter the cavity between the two plate portions through the through hole provided on the connection plate.

Optionally, the connection plate includes an inclining portion that inclines downwards, and the through hole is provided on the inclining portion. The connection plate a) may extend along a vertical direction, or b) may form a slope that inclines downwards. Relative to the solution a), the solution b) better facilitates entering of the foaming liquid by providing a hole on the slope.

Optionally, the inclining portion is provided with multiple through holes that are distributed at a preset interval.

Optionally, a free end of the upper plate portion and/or a free end of the lower plate portion abut/abuts against the front wall. The free end of the upper plate portion abuts against the front wall of the beam, which can improve the reinforcing effect of the beam.

Optionally, the refrigeration device further includes: a reinforcing block at a lower left corner and a reinforcing block at a lower right corner, which are fixed on the bottom wall and the front wall, where two ends of the reinforcing member are respectively fixed to the reinforcing block at the lower left corner and the reinforcing block at the lower right corner. The reinforcing block at the lower left corner and the reinforcing block at the lower right corner are respectively used for reinforcing strength of a lower left corner and a lower right corner of the housing. The solution provides a specific solution for fixing of two ends of the reinforcing member. The two ends of the reinforcing member may also be directly fixed to the beam.

Optionally, in a width direction of the refrigeration device, the two ends of the reinforcing member overlap with the reinforcing block at the lower left corner and the reinforcing block at the lower right corner. That is, in left and right dimension directions, the two ends of the reinforcing member are fixed to upper surfaces of the reinforcing block at the lower left corner and the reinforcing block at the lower right corner, which is conducive to improving firmness and operational convenience of fixing.

Optionally, the reinforcing block at the lower left corner and the reinforcing block at the lower right corner respectively include fixing portions for fixing corresponding ends of the reinforcing member, and in a vertical direction, the fixing portions are higher than the bottom wall, and there is a distance between the fixing portions and the bottom wall. Furthermore, the reinforcing member includes an upper plate portion and a lower plate portion that are opposite to each other; in a vertical direction, the fixing portions are located between the upper plate portion and the lower plate portion; and in a width direction of the refrigeration device, the fixing portions are located on two sides of the upper plate portion. More specifically, the reinforcing block at the lower left corner and the reinforcing block at the lower right corner respectively include vertical walls adhering to the front wall; and tabs that are connected to the vertical walls and extend in a direction departing from the front wall serve as the fixing portions. The solution provides a more specific solution for fixing structures on the reinforcing block at the lower left corner and the reinforcing block at the lower right corner that are suitable for the two ends of the reinforcing member.

Optionally, the reinforcing member has flanges whose extension directions are the same as those/that of the upper plate portion and/or the lower plate portion, where the flanges are suitable to be fixed to the fixing portions so as to fix the reinforcing member on the beam. The solution provides a specific solution for fixing structures at the two ends of the reinforcing member.

Optionally, a U-shaped groove is formed between the flanges and the lower plate portion. The solution provides a specific solution for specific positions of the flanges.

Optionally, the flanges are fixed to the fixing portions by using a screw. A mechanical fixing manner such as a screw has higher firmness compared with a fixing manner such as bonding.

Optionally, a left hinge and/or a right hinge suitable to be connected to a door are/is provided at an opening of the inner liner, where the reinforcing block at the lower left corner and the reinforcing block at the lower right corner are respectively a lower left hinge reinforcing block and a lower right hinge reinforcing block for enhancing strength of a lower end of the left hinge and a lower end of the right hinge. For some refrigeration device platforms having hinges, the reinforcing block at the lower left corner and the reinforcing block at the lower right corner may be a lower left hinge reinforcing block and a lower right hinge reinforcing block. For some refrigeration device platforms that do not have hinges, the reinforcing block at the lower left corner and the reinforcing block at the lower right corner may be used for enhancing strength of the lower left corner and the lower right corner of the housing.

Optionally, a folded-shaped plate is connected inside the front wall; a clamping groove is formed inside the folded-shaped plate, and a lower flange of the inner liner is suitable to be locked in the clamping groove; and a free end of the upper plate portion of the reinforcing member is suitable to abut against a bottom of the folded-shaped plate. The bottom of the clamping groove defines the size of the opening of the reinforcing member.

Other features which are considered as characteristic for the invention are set forth in the appended claims.

Although the invention is illustrated and described herein as embodied in a refrigeration device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWING FIGURES

DETAILED DESCRIPTION OF THE INVENTION

Figure 1:
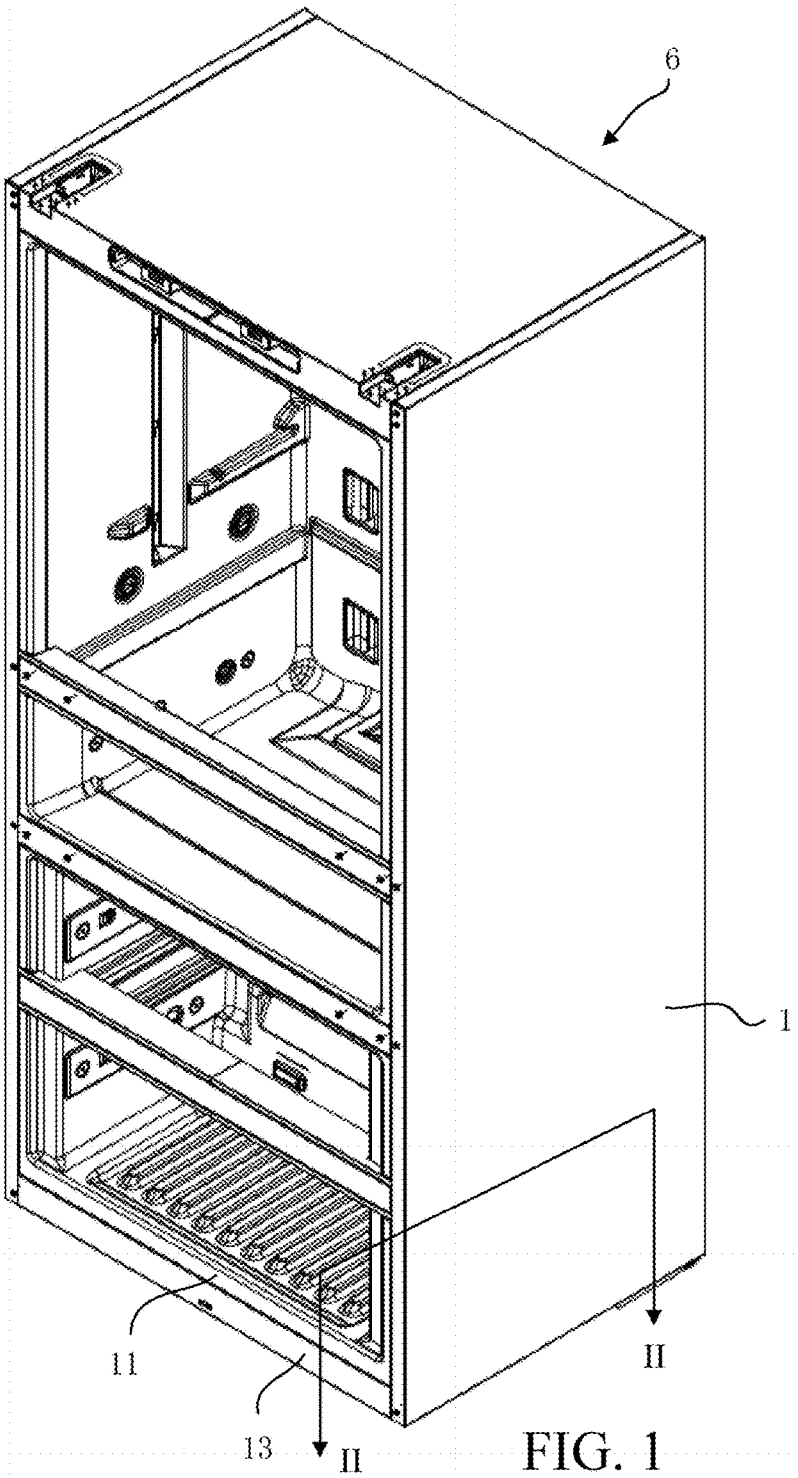
FIG. 1 is a schematic structural diagram of refrigeration device according to an embodiment of the present invention.
Figure 2:
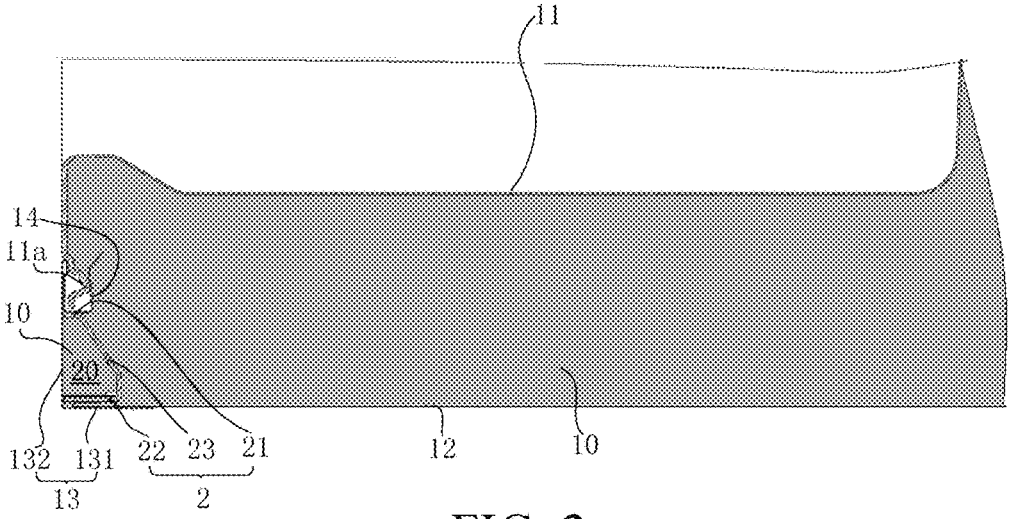
FIG. 2 is an enlarged sectional view of the refrigeration device in FIG. 1 taken along the section line II-II.

Referring now to the figures of the drawing in detail and first, particularly, to FIGS. 1 and 2 thereof, there is shown a schematic structural diagram of refrigeration device according to an embodiment of the present invention. FIG. 2 is a sectional view of the refrigeration device in FIG. 1 along the straight line II-II.

The refrigeration device 6 includes:

a housing 1, or cabinet 1, including an inner liner 11, a lower housing plate 12, a beam 13 that has a bottom wall 131 and a front wall 132, and a foamed thermal insulation material 10 located between the lower housing plate 12 and the inner liner 11; the bottom wall 131 of the beam 13 is connected to the lower housing plate 12, and the front wall 132 is connected to the inner liner 11; and a reinforcing member 2 affixed on the beam 13 for enhancing the strength of the bottom wall 131; the reinforcing member 2 is located between the bottom wall 131 and the inner liner 11; and wherein a cavity 20 is formed between the reinforcing member 2 and the front wall 132, and the thermal insulation material 10 is filled in the cavity 20.

The refrigeration device 6 may be a refrigerator/wine cabinet. The inner liner 11 encloses at least one storage chamber, for example, a refrigerating chamber, a freezing chamber, a temperature variable chamber, and/or an ice temperature chamber.

The beam 13 is a connector, and connects the inner liner 11 and the lower housing plate 12. The beam 13 may include two parts: a bottom wall 131 and a front wall 132. The two parts may be integrally formed, and may also be connected together after separate manufacturing.

It may be understood that the bottom wall 131 of the beam is prone to impact and collision during transportation of the refrigeration device 6.

Figure 3:
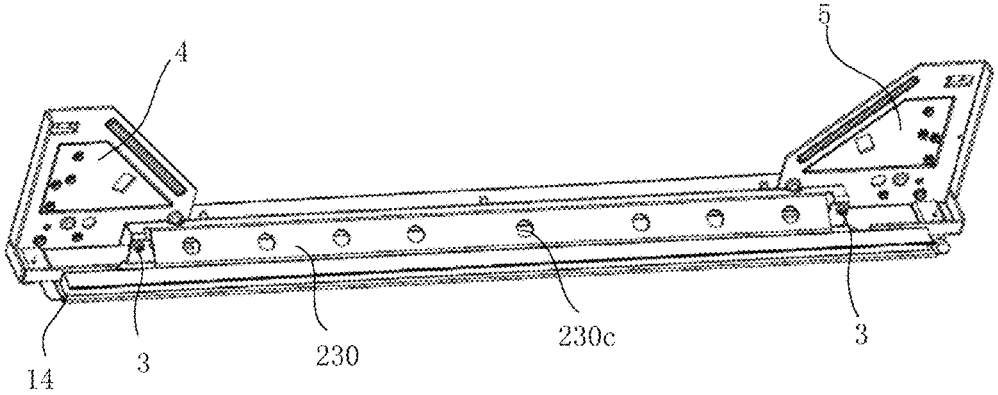
FIG. 3 is a perspective view of an assembly structure of a beam, a lower left hinge reinforcing block, a lower right hinge reinforcing block, and a reinforcing member.
Figure 4:
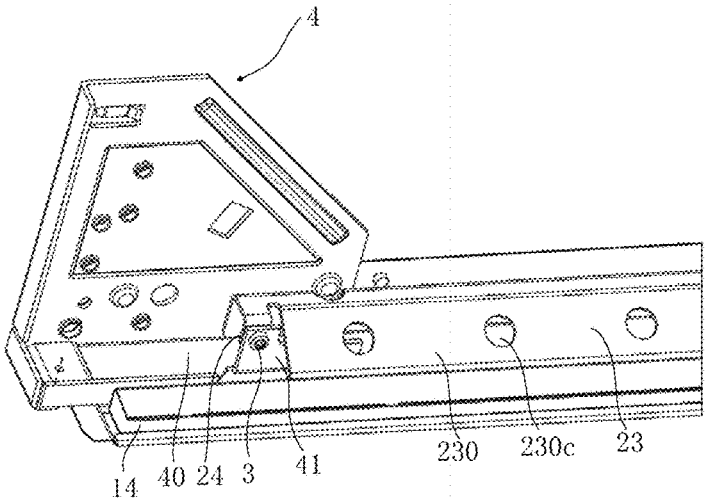
FIG. 4 is an enlarged view of a partial structure in FIG. 3.
Figure 5:
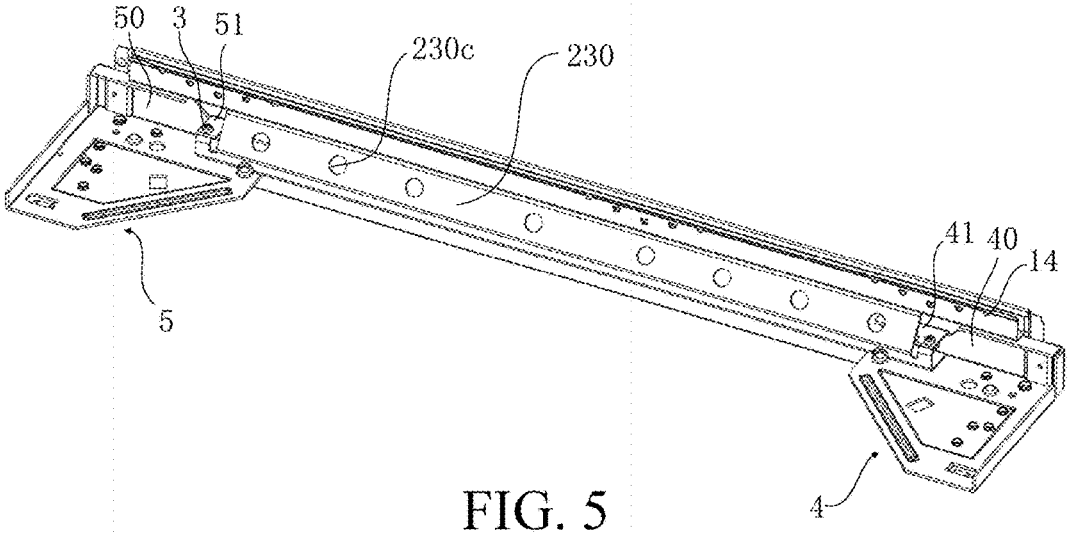
FIG. 5 is a perspective view of an assembly structure of a beam, a lower left hinge reinforcing block, a lower right hinge reinforcing block, and a reinforcing member.
Figure 6:
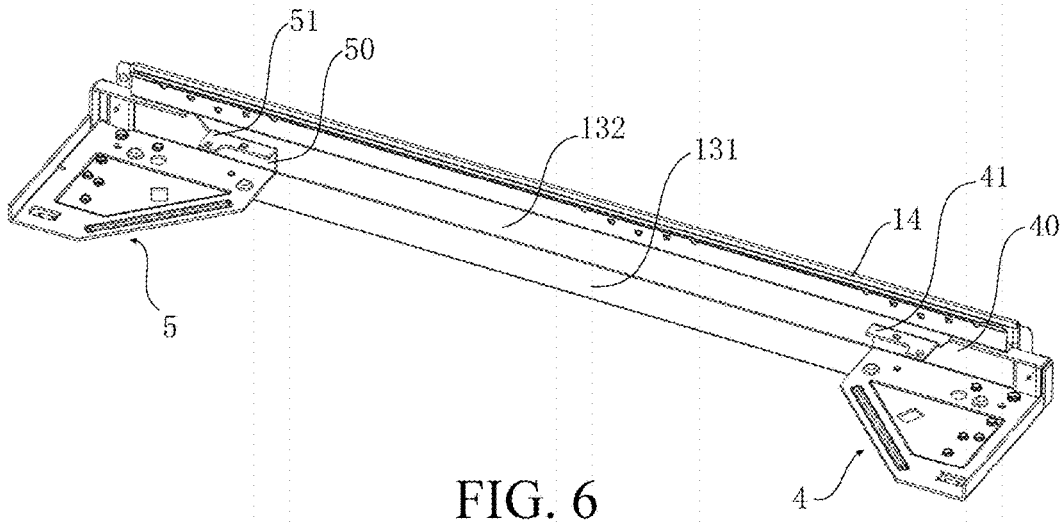
FIG. 6 is a schematic diagram after the reinforcing member is removed from the assembly structure in FIG. 5.
Figure 7:
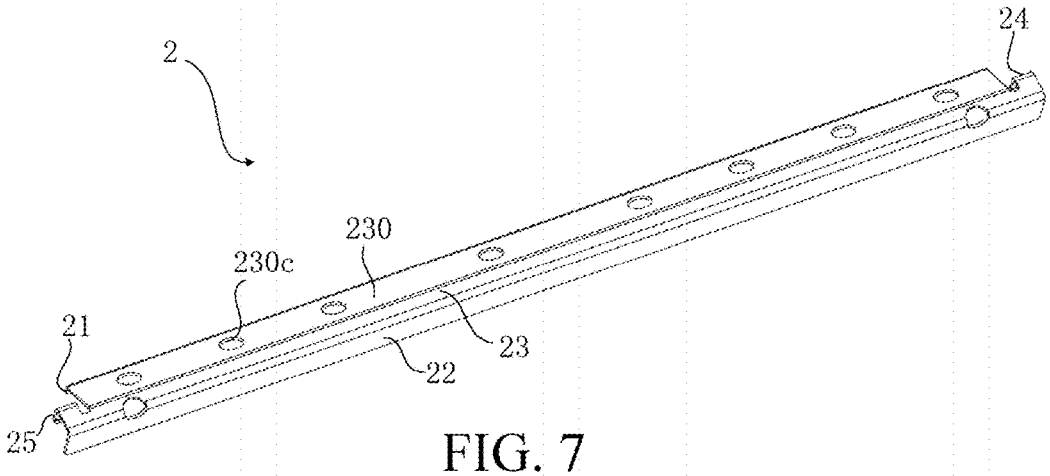
FIG. 7 is a perspective and schematic structural diagram of the reinforcing member illustrated in FIG. 5.

FIG. 3 is a schematic diagram of an assembly structure of a beam, a lower left hinge reinforcing block, a lower right hinge reinforcing block, and a reinforcing member from a perspective. FIG. 4 is an enlarged view of a partial structure in FIG. 3. FIG. 5 is a schematic diagram of an assembly structure of a beam, a lower left hinge reinforcing block, a lower right hinge reinforcing block, and a reinforcing member from another perspective. FIG. 6 is a schematic diagram after the reinforcing member is removed from the assembly structure in FIG. 5. FIG. 7 is a schematic structural diagram of the reinforcing member in FIG. 5.

Referring to FIG. 7, in this embodiment, the reinforcing member 2 includes an upper plate portion 21, a lower plate portion 22, and a connection plate 23 connecting the upper plate portion 21 and the lower plate portion 22.

In this embodiment, a left hinge and a right hinge (not shown) are provided between the door (not shown) on the housing 1 and the inner liner 11. A lower left hinge and a lower right hinge located at a lower end of the left hinge and a lower end of the right hinge are correspondingly provided with a lower left hinge reinforcing block 4 and a lower right hinge reinforcing block 5 (refer to FIG. 3 and FIG. 5), for enhancing strength of the lower left hinge and the lower right hinge. The lower left hinge reinforcing block 4 and the lower right hinge reinforcing block 5 are fixed to the bottom wall 131 and the front wall 132 of the beam 13 by using a screw or in another mechanical fixing manner.

In this embodiment, the two ends of the reinforcing member 2 are respectively fixed to upper surfaces of the lower left hinge reinforcing block 4 and the lower right hinge reinforcing block 5. Referring to FIG. 6, the lower left hinge reinforcing block 4 and the lower right hinge reinforcing block 5 respectively have fixing portions 41, 51 for fixing corresponding two ends of the reinforcing member 2. In a vertical direction, the fixing portions 41, 51 are higher than the bottom wall 131 of the beam 13, and there is a distance between the fixing portions 41, 51 and the bottom wall 131.

Specifically, the lower left hinge reinforcing block 4 and the lower right hinge reinforcing block 5 respectively include vertical walls 40, 50 adhering to the front wall 132, the vertical walls 40, 50 are connected to tabs extending in a direction departing from the front wall, and the two ends of the reinforcing member 2 are fixed to the tabs. In other words, the two tabs serve as the fixing portions 41, 51.

Referring to FIG. 7 and FIG. 4, the reinforcing member 2 has flanges 24, 25 whose extension directions are the same as those/that of the upper plate portion 21 and/or the lower plate portion 22. The flanges 24, 25 and the tabs serving as the fixing portions 41, 51 fix the reinforcing member 2 on the beam 13 by using a screw 3 or in another mechanical fixing manner.

Referring to FIG. 7, the flanges 24, 25 are located at two ends of the connection plate 23, and a U-shaped groove is formed between the flanges 24, 25 and the lower plate portion 22. Referring to FIG. 4 and FIG. 5, fixing portions 41, 51 fixed to the flanges 24, 25 are located between the lower plate portion 21 and the lower plate portion 22 of the reinforcing member 2 in a vertical direction, and located on two sides of the upper plate portion 21 in a left-right width direction.

In this embodiment, by using the flanges 24, 25 and the tabs, the two ends of the reinforcing member 2 are respectively fixed to upper surfaces of the lower left hinge reinforcing block 4 and the lower right hinge reinforcing block 5, to be firmly fixed. In another embodiment, the two ends of the reinforcing member 2 may be fixed to side surfaces of the lower left hinge reinforcing block 4 and the lower right hinge reinforcing block 5, or may even be directly fixed, in a mechanical fixing manner, to the beam 13, which may specifically be the front wall 132 of the beam.

In addition, in this embodiment, the fixing manner of the two ends of the reinforcing member 2 is applicable to the refrigeration device platforms having hinges. In another embodiment, for some refrigeration device platforms that do not have hinges, the two ends of the reinforcing member 2 can be fixed to upper surfaces of the reinforcing block at the lower left corner and the reinforcing block at the lower right corner. Correspondingly, the reinforcing block at the lower left corner and the reinforcing block at the lower right corner may also respectively include vertical walls adhering to the front wall 132, the vertical walls are connected to tabs that extend in a direction departing from the front wall 132, and the tabs serve as the fixing portions 41, 51 for fixing the two ends of the reinforcing member 2. The reinforcing block at the lower left corner and the reinforcing block at the lower right corner are correspondingly used for enhancing strength of the lower left corner and the lower right corner of the housing 1.

Referring to FIG. 2 and FIG. 5, a folded-shaped plate 14 is connected inside the front wall 132 of the beam 13, a clamping groove is formed inside the folded-shaped plate 14, and a lower flange 11*a* of the inner liner 11 is suitable to be locked in the clamping groove. To define the size of the opening of the reinforcing member 2, the lower plate portion 22 of the reinforcing member 2 is horizontal and located on the bottom wall 131 of the beam 13, and a free end of the upper plate portion 21 is suitable to abut against a bottom of the folded-shaped plate 14.

A free end of the upper plate portion 21 and/or a free end of the lower plate portion 22 may abut against the front wall 132 of the beam 13.

After the reinforcing member 2 is assembled in the housing 1, foaming is performed for them. The foaming process is: a hot foaming liquid flows between the lower housing plate 12, the beam 13, and the inner liner 11 of the housing 1, and after cooling, cures to form the thermal insulation material 10.

Referring to FIG. 3 to FIG. 7, in this embodiment, the connection plate 23 is provided with a through hole 230*c* for the foaming liquid in the foaming process to pass through, which enters the cavity 20 enclosed by the reinforcing member 2 and the front wall 132 of the beam 13. There may be multiple through holes 230*c* that are distributed at a preset interval. In another embodiment, the connection plate 23 may also not be provided with any through hole 230*c*. In this case, the foaming liquid enters the cavity 20 from the two ends of the reinforcing member 2, for example, from gaps between the flanges 24, 25 and the upper plate portion 21 as well as the connection plate 23. To facilitate flowing of the foaming liquid, the connection plate 23 may further include an inclining portion 230 that inclines downwards, and the through hole 230*c* is provided on the inclining portion 230. In another embodiment, the connection plate 23 may also extend in a vertical direction.

Referring to FIG. 2, the reinforcing member 2 which encloses the cavity 20 with the front wall 132 of the beam 13 enables the reinforcing member 2 and the bottom wall 131 jointly resist impact of the collision on the bottom wall 131, which is therefore conducive to preventing deformation of the bottom wall 131. In addition, the thermal insulation material 10 inside and outside the cavity 20 enables the beam 13 and the reinforcing member 2 to form a whole for bearing a force, further preventing the deformation of the bottom wall 131.

The lower plate portion 22 horizontally adheres to the upper surface of the bottom wall 131 of the beam 13, which, on one hand, can resist deformation of the bottom wall 131 by selecting a lower plate portion 22 with strong rigidity, and on the other hand, can directly transfer the deformation of the bottom wall 131 to the lower plate portion 22.

The reinforcing member 2 extends along a width direction of the refrigeration device 6, for example, between left and right hinges. It may be understood that a better strength enhancement effect can be achieved for a bottom wall 131 of a beam of refrigeration device with a greater width.

Although an exemplary embodiment of the present invention is described above, the present invention is not limited thereto. Any person skilled in the art can make various variations and modifications without departing from the spirit and scope of the present invention. Therefore, the protection scope of the present invention should be subject to the scope defined by the claims.

The invention claimed is:

1. A refrigeration device, comprising:

a housing having an inner liner and a lower housing plate, a beam with a bottom wall connected to said lower housing plate and a front wall connected to said inner liner;

a thermal insulation material formed by foaming between said lower housing plate and said inner liner; and a reinforcing member affixed on said beam for enhancing a strength of said bottom wall, said reinforcing member being disposed between said bottom wall and said inner liner; and said reinforcing member and said front wall being disposed to form a cavity therebetween, and having the thermal insulation material filled in said cavity between said reinforcing member and said front wall.

2. The refrigeration device according to claim 1, wherein:

said reinforcing member comprises an upper plate portion and a lower plate portion opposite one another;

said cavity is formed between said upper plate portion and said lower plate portion, and said lower plate portion adheres to said bottom wall of said beam.

3. The refrigeration device according to claim 2, wherein said reinforcing member comprises a connection plate connected to an end of said upper plate portion and an end of said lower plate portion, and wherein said connection plate is formed with a through hole for a foaming liquid to pass through during a foaming process.

4. The refrigeration device according to claim 3, wherein said connection plate comprises an inclining portion that inclines downwards and said through hole is formed in said inclining portion.

5. The refrigeration device according to claim 4, wherein said inclining portion is formed with a plurality of through holes that are distributed at a preset interval.

6. The refrigeration device according to claim 2, wherein one or both of a free end of said upper plate portion and a free end of said lower plate portion abut against the front wall.

7. The refrigeration device according to claim 1, which further comprises a reinforcing block at a lower left corner of said housing and a reinforcing block at a lower right corner of said housing, and wherein:

said reinforcing blocks are fixed on said bottom wall and said front wall; and a first end of said reinforcing member is affixed to said reinforcing block at the lower left corner and a second end of said reinforcing member is affixed to said reinforcing block at the lower right corner.

8. The refrigeration device according to claim 7, wherein in a width direction of said housing, said first and second ends of said reinforcing member overlap with said reinforcing block at the lower left corner and said reinforcing block at the lower right corner.

9. The refrigeration device according to claim 7, wherein said reinforcing block at the lower left corner and said reinforcing block at the lower right corner respectively comprise fixing portions for fixing corresponding ends of said reinforcing member, and in a vertical direction, said fixing portions are higher than said bottom wall, and there is a spacing distance between said fixing portions and said bottom wall.

10. The refrigeration device according to claim 9, wherein:

said reinforcing member comprises an upper plate portion and a lower plate portion opposite one another;

in a vertical direction, said fixing portions are located between said upper plate portion and said lower plate portion; and in a width direction of said housing, said fixing portions are located on two sides of said upper plate portion.

11. The refrigeration device according to claim 10, wherein said reinforcing block at the lower left corner and said reinforcing block at the lower right corner respectively comprise vertical walls adhering to said front wall; and wherein said fixing portions are formed by tabs that are connected to the vertical walls and extend in a direction departing from said front wall.

12. The refrigeration device according to claim 11, wherein said reinforcing member has flanges whose extension directions are the same as the extension direction of at least one of said upper plate portion or said lower plate portion, wherein said flanges are configured to be fixed to said fixing portions so as to affix said reinforcing member on said beam.

13. The refrigeration device according to claim 10, wherein said reinforcing member has flanges whose extension directions are the same as the extension direction of at least one of said upper plate portion or said lower plate portion, wherein said flanges are configured to be fixed to said fixing portions so as to affix said reinforcing member on said beam.

14. The refrigeration device according to claim 9, wherein said reinforcing block at the lower left corner and said reinforcing block at the lower right corner respectively comprise vertical walls adhering to said front wall; and wherein said fixing portions are formed by tabs that are connected to the vertical walls and extend in a direction departing from said front wall.

15. The refrigeration device according to claim 12, wherein a U-shaped groove is formed between said flanges and said lower plate portion.

16. The refrigeration device according to claim 12, wherein said flanges are affixed to said fixing portions by a screw.

17. The refrigeration device according to claim 7, wherein at least one of a left hinge or a right hinge for connecting a door is provided at an opening of said inner liner, wherein said reinforcing block at the lower left corner and said reinforcing block at the lower right corner are respectively a lower left hinge reinforcing block and a lower right hinge reinforcing block for enhancing a strength of a lower end of said left hinge and a lower end of said right hinge, respectively.

18. The refrigeration device according to claim 2, which comprises:

a folded-shaped plate connected inside said front wall;

said folded-shaped plate forming a clamping groove and a lower flange of said inner liner being disposed to be locked in said clamping groove; and a free end of said upper plate portion of said reinforcing member being configured to abut against a bottom of said folded-shaped plate.

19. The refrigeration device according to claim 1, wherein said reinforcing member has a plate portion that abuts against said front wall to delimit a portion of said cavity.

20. The refrigeration device according to claim 1, wherein said reinforcing member has a plate portion parallel to and adhered to said bottom wall of said beam.

* * * * *